US010194511B1

(12) United States Patent
Hieb

(10) Patent No.: US 10,194,511 B1
(45) Date of Patent: Jan. 29, 2019

(54) SYSTEMS AND METHODS FOR FACILITATING LIGHTING DEVICE HEALTH MANAGEMENT

(71) Applicant: Echostar Technologies L.L.C., Englewood, CO (US)

(72) Inventor: Eric Ray Hieb, Parker, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 0 days.

(21) Appl. No.: 15/664,743

(22) Filed: Jul. 31, 2017

(51) Int. Cl.
*H05B 37/02* (2006.01)
*H05B 37/03* (2006.01)

(52) U.S. Cl.
CPC ..... *H05B 37/0272* (2013.01); *H05B 37/03* (2013.01)

(58) Field of Classification Search
CPC ..... H05B 37/02; H05B 37/0272; H05B 37/0245; H05B 37/038; H05B 33/08; H05B 33/0842; H05B 33/0824; H05B 33/0848
See application file for complete search history.

(56) References Cited

U.S. PATENT DOCUMENTS 8,729,834 B1 * 5/2014 Funderburk ..... H05B 37/0245 315/312
9,686,842 B1 * 6/2017 Coombes ..... H04L 67/12
2015/0130359 A1 * 5/2015 Bosua ..... H05B 37/0245 315/160
2016/0050723 A1 * 2/2016 Gochnauer ..... H05B 33/086 315/151
2016/0057839 A1 * 2/2016 Kwag ..... H05B 37/0272 315/291

* cited by examiner

*Primary Examiner* — Thai Pham
(74) *Attorney, Agent, or Firm* — Kilpatrick Townsend & Stockton LLP

(57) ABSTRACT

Systems, methods, apparatus, and machine-readable media are provided to facilitate lighting device health management. Conditions of at least a portion of an electric light assembly may be monitored with a monitor adapted to be disposed in the electric light assembly. The electric light assembly may include an electric light source and a receptacle adapted to receive the electric light source. Based on the monitoring, data recordings corresponding to operations of the electric light assembly over a period of time may be stored. Reporting data may be created based on the stored data recordings. A communication may be wirelessly transmitted with the monitor toward a system controller that is remote from the electric light assembly. The communication may include the reporting data. The monitor may correspond to the electric light source or a receptacle adapted to receive the electric light source.

20 Claims, 8 Drawing Sheets

500

SYSTEMS AND METHODS FOR FACILITATING LIGHTING DEVICE HEALTH MANAGEMENT

BACKGROUND

The present disclosure relates in general to device control, and, more specifically, but not by way of limitation, to systems, methods, and apparatus for facilitating lighting device health management.

A ubiquitous fact of modern life is the fact that light bulbs are always burning out or otherwise failing. Often that occurs at the most inopportune times. A related aspect is that modern light bulbs are often relatively expensive compared to traditional incandescent light bulbs. As more consumers use more expensive light bulbs, it is less likely that consumers keep extras on hand.

Thus, there is a need for systems and methods that address such problems and related problems. This and other needs are addressed by the present disclosure.

BRIEF SUMMARY

Certain embodiments of the present disclosure relate in general to device control, and, more specifically, but not by way of limitation, to systems, methods, and apparatus for facilitating lighting device health management.

In one aspect, a system to facilitate electric lighting device management is disclosed. The system may include one or a combination of the following. A monitor may be adapted to be disposed in an electric light assembly. The electric light assembly may include an electric light source and a receptacle adapted to receive the electric light source. The monitor may be configured to performing one or a combination of the following. One or more conditions of at least a portion of the electric light assembly may be monitored. Based at least in part on the monitoring, a plurality of data recordings corresponding to operations of the electric light assembly over a period of time may be stored. Reporting data may be created based at least in part on the stored plurality of data recordings. A communication may be wirelessly transmitted toward a system controller that is remote from the electric light assembly. The communication may include the reporting data. The monitor may correspond to the electric light source or a receptacle adapted to receive the electric light source.

In another aspect, a method to facilitate electric lighting device management is disclosed. The method may include performing one or a combination of the following. One or more conditions of at least a portion of an electric light assembly may be monitored with a monitor device adapted to be disposed in the electric light assembly. The electric light assembly may include an electric light source and a receptacle adapted to receive the electric light source. Based at least in part on the monitoring, a plurality of data recordings corresponding to operations of the electric light assembly over a period of time may be stored with the monitor. Reporting data may be created with the monitor based at least in part on the stored plurality of data recordings. A communication may be wirelessly transmitted with the monitor toward a system controller that is remote from the electric light assembly. The communication may include the reporting data. The monitor may correspond to the electric light source or a receptacle adapted to receive the electric light source.

In yet another aspect, one or more non-transitory, machine-readable media are disclosed. The one or more non-transitory, machine-readable media may have instructions thereon which, when executed by one or more processing devices, cause the one or more processing devices to perform one or a combination of the following. One or more conditions of at least a portion of an electric light assembly may be monitored with a monitor adapted to be disposed in the electric light assembly. The electric light assembly may include an electric light source and a receptacle adapted to receive the electric light source. Based at least in part on the monitoring, a plurality of data recordings corresponding to operations of the electric light assembly over a period of time may be stored. Reporting data may be created based at least in part on the stored plurality of data recordings. A communication may be wirelessly transmitted toward a system controller that is remote from the electric light assembly. The communication may include the reporting data. At least one of the one or more processing devices may correspond to the electric light source or a receptacle adapted to receive the electric light source.

In various embodiments, the operation of wirelessly transmitting the communication toward the system controller may include transmitting the communication directly to the system controller. In various embodiments, the operation of wirelessly transmitting the communication toward the system controller may include transmitting the communication indirectly to the system controller by way of one or more other electric light assemblies. In various embodiments, the monitor and/or at least one of the one or more processing devices may be further configured to control one or more functions of the electric light source.

In various embodiments, the monitor and/or at least one of the one or more processing devices may be further configured to generate an assessment of the electric light source functions. The reporting data may include the assessment. The assessment may indicate a remaining operational expectancy of the electric light source.

Various embodiments may include the system controller. Various embodiments may include wirelessly communicating with a set of monitors. In some embodiments, the set of monitors may include the monitor and/or the at least one of the one or more processing devices. Various embodiments may include monitoring the set of monitors. In various embodiments, the system controller may be further configured to generate an assessment of the electric light source functions based at least in part on the reporting data. The assessment may indicate a remaining operational expectancy of the electric light source.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. When only the first reference label is used in the specification, the description is applicable to any one of the similar components having the same first reference label irrespective of the second reference label.

DETAILED DESCRIPTION

Figure 1A:
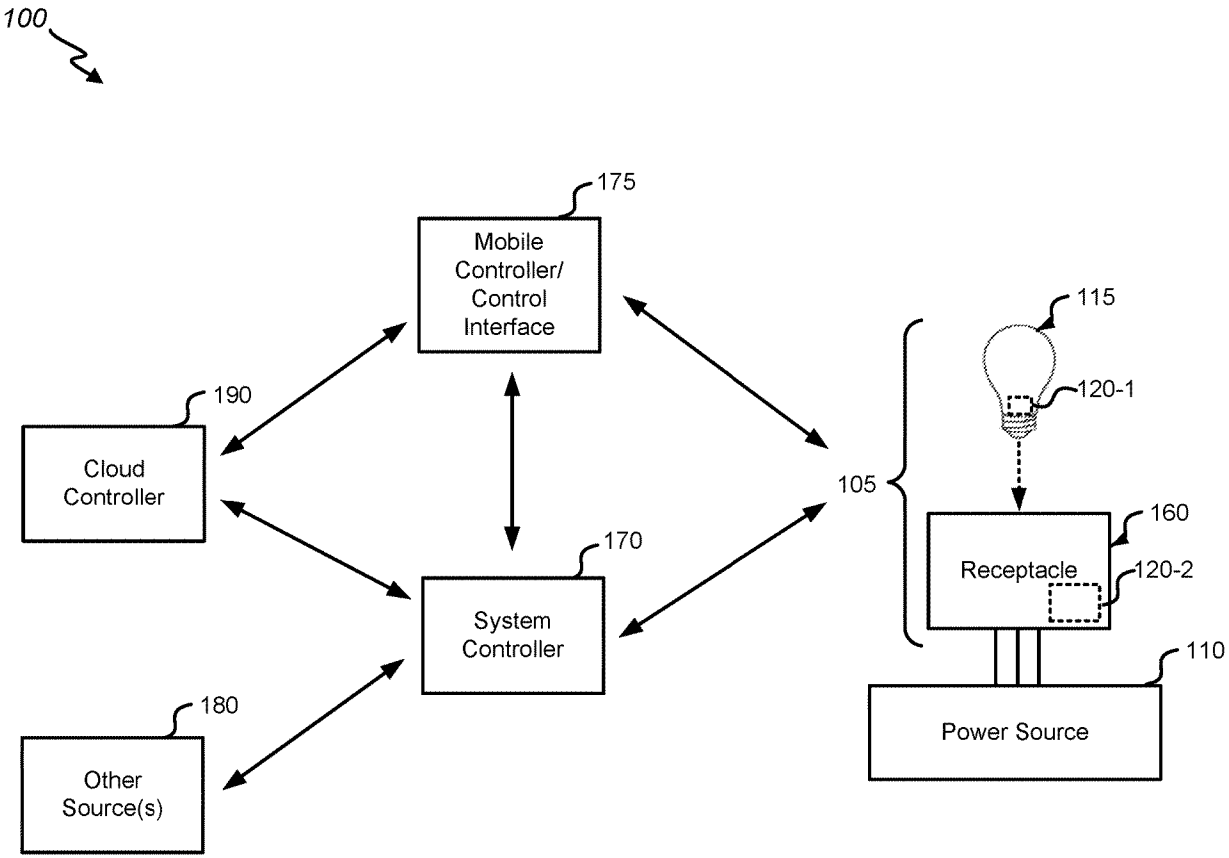
FIG. 1A illustrates a diagram of an overview of a system to facilitate electric lighting device health management, in accordance with certain embodiments of present disclosure.

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Specific details are given in the following description to provide a thorough understanding of the embodiments. However, it will be understood by one of conventional skill in the art that the embodiments maybe practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Certain embodiments according to the present disclosure may provide for a smart light system. Certain embodiments may provide for a system to facilitate electric lighting device health management. Various embodiments may be directed to various types of electric lighting devices. By way of example, the various types of electric lighting devices may include incandescent lights, fluorescent lights, halogen lights, light emitting diode (LED) lights, compact fluorescent lamps (CFLs), tungsten lights, and/or the like.

Certain embodiments may include one or more electric light assemblies. An electric light assembly may include an electric light source and a receptacle adapted to receive the electric light source. In various embodiments, the electric light source may correspond to any suitable electric light, such as a smart light bulb, an LED light, a CFL light, and/or the like. In some embodiments, the receptacle adapted to receive the electric light source may correspond to an electric light socket.

Certain embodiments may include a smart electric light assembly (variously referenced as "smart light assembly," "electric light assembly," or "light assembly" herein). Certain embodiments may provide for smart light assemblies that are self-aware. For example, certain embodiments of a smart light assembly may provide for health-monitoring so that the smart light assembly may be self-aware with respect to its own health. Some embodiments may include a health monitor adapted to be disposed in an electric light assembly. With the health monitor, the smart light assembly may monitor sensor data with respect to operations of the smart light assembly. Based at least in part on monitoring the sensor data, the smart light assembly may monitor one or more conditions of at least a portion of the electric light assembly. The smart light assembly may be configured to store data recordings corresponding to its operations over a period of time. Additionally, the smart light assembly may be configured to create reporting data based at least in part on the stored data recordings. The smart light assembly may be further configured to wirelessly transmit communications toward one or more remote devices and/or systems. Such communications may include the reporting data in some embodiments.

In some embodiments, the electronic communications may be directed toward a system controller. In some embodiments, a smart light assembly may be individually controlled from any paired system controller with a smart control application on a system controller. With some such embodiments, the smart light assembly may wirelessly transmit the communications directly to the system controller. With other embodiments, the smart light assembly may wirelessly transmit the electronic communications indirectly to the system controller, via one or more other smart light assemblies and/or one or more other communicably coupled devices. The system controller may monitor electronic communications, received via one or more interfaces, from the smart light assemblies to identify light-usage durations. In some embodiments, the system controller may update a usage-patterns data store to associate each of the smart light assemblies with usage data based at least partially on one or more of the identified light-usage durations. Some embodiments of the system controller may further associate the identified light-usage durations with health records for each of the smart light assemblies. With some embodiments, the system controller may detect a location associated with each electronic communication from one or more smart light assemblies in order to identify a location of each of the one or more smart light assemblies. With some embodiments, the electronic communications monitored by the usage monitor of the system controller may include sensor data from sensors associated with the smart light assemblies. The usage monitor of the system controller may update the usage-pattern data store at least in part based on the particular type of sensor data detected.

Some embodiments of the system controller may further associate one or more task types with the smart light assemblies based at least in part on the identified light-usage durations. The system controller and/or the smart light assembly may evaluate health records of particular smart light assemblies based at least partially on the usage data and an alteration condition. When it is determined that the alteration condition is satisfied, a corresponding task may be identified.

Certain embodiments may provide for smart light assemblies that facilitate at least partially autonomous maintenance actions. The communications that include the reporting data from one or more smart light assemblies may facilitate at least partially autonomous maintenance actions. For example, the system controller may analyze the reporting data with respect to one or more operational thresholds and determine whether one or more replacements for the electric light source (e.g., replacement light bulbs) are (or will be) needed. The system controller may in turn transmit a notification to one or more end-user devices previously associated with the system controller and/or place an order for one or more replacements with a resource-controlling system via one or more networks.

In some embodiments, the notification to the one or more end-user devices may include a task-performance duration. The notification may further facilitate the one or more end-user devices to perform a correspond task, such as place an order for one or more replacements with a resource-controlling system via one or more networks. To facilitate the task performance, the notification may include a user-selectable option to specify to ordering one or more replacements with a resource-controlling system. In some cases, the user-selectable option may include a URL specific to the replacement resource.

Additionally or alternatively, the communications from one or more smart light assemblies may include various commands in various embodiments. For example, in some embodiments, a command may correspond to a request to order one or more replacements for the electric light source after the smart light assembly has analyzed its data recordings with respect to one or more operational thresholds and determined that there is (or will be) a need for a replacement. The request to order may be directed to a system controller in some embodiments. The system controller may in turn transmit a notification to one or more end-user devices previously associated with the system controller and/or place an order for one or more replacements with a resource-controlling system via one or more networks. With other embodiments, the request to order may be directed to a resource-controlling system via one or more networks, such that the smart light assembly directly places a replacement order.

Accordingly, the one or more smart light assemblies and/or the system controller may be configured to be one or more operational maintenance devices for the electric light sources. To facilitate such operational maintenance actions, various embodiments may provide one or more interfaces that: receive electronic communications from one or more smart light assemblies, transmit electronic communications to one or more smart light assemblies, transmit electronic communications to one or more end-user devices, receive electronic communications from one or more end-user devices, transmit electronic communications to one or more resource-controlling systems (e.g., an online service provider), receive electronic communications from one or more resource-controlling systems, and/or the like.

Certain embodiments may further provide for intelligent timetable management. A timetable monitor may update one or more timetables in a timetable data store. In some embodiments, the timetable monitor may monitor electronic communications, received via one or more interfaces, from one or more smart light assemblies, the system controller, and/or one or more remote resource-controlling systems. The timetable monitor may identify updates to timetables of smart light assemblies and/or replacement orders. The timetables of smart light assemblies may indicate assessments of usage, expected life balance, predicted end of life, and/or the like. The timetables of replacement orders may indicate lead time for replacement orders, buffer time for shipping after order placement, buffer time for restoring a light source (rather than assuming immediate restoration), and/or the like. The timetable monitor may update the timetables based at least partially on historically monitored actions.

Certain embodiments may further provide for replacement inventory tracking. The system controller and/or the smart light assembly may track quantities of replacements versus replacements used. For example, with embodiments where either the smart assembly or the system controller directly place a replacement order, the quantity of replacement lights ordered may be tracked. The tracked quantity of replacement lights ordered may be added to a current inventory record upon reception of a delivery notification or after an estimated delivery time has passed. Further, burnt-out or otherwise non-functional lights may be logged. Installations of replacements of the burnt-out or otherwise non-functional lights may be detected. Such installations may be logged, and the current inventory record may be updated to decrement an estimated quantity of on-premise replacements.

Various embodiments of a smart light assembly may include a health monitor in various components of the smart light assembly. In some embodiments, the electric light source may be any suitable commercially available electric light. Yet, in other embodiments, the electric light source may be a smart light that includes a health monitor in accordance with certain embodiments of the present disclosure. The smart light in such embodiments may be adapted for insertion into conventional receptacles—e.g., the smart light may be screwed into a conventional receptacle.

In some embodiments, the receptacle may be any suitable commercially available receptacle adapted to receive the electric light source. Yet, in other embodiments, the receptacle may be a smart receptacle that includes a health monitor in accordance with certain embodiments of the present disclosure. The smart receptacle may be implemented in lieu of the conventional receptacle and may be adapted to receive the electric light (e.g., a light bulb that may be screwed into the smart receptacle).

In some embodiments, both the electric light source and the receptacle may be any suitable commercially available electric light and receptacle, respectively. With such instances, certain embodiments may include a smart adaptor configured to couple the electric light source and the receptacle. The smart adaptor may, for example, correspond to a smart receptacle configured as an extension of the conventional receptacle, that may be inserted in the conventional receptacle (e.g., screwed into the conventional receptacle), and that may receive the electric light (e.g., a light bulb that may be screwed into the smart adaptor). Accordingly, the smart adaptor may include a health monitor in certain embodiments.

Various embodiments may include a plurality of smart light assemblies. In such embodiments, the plurality of smart light assemblies may be communicatively interconnected according to various topologies according to various embodiments. In some embodiments, the plurality of smart light assemblies may be communicatively interconnected according to a wireless mesh network topology. In some embodiments, the plurality of smart light assemblies may be communicatively interconnected according to a wireless central hub/control system topology.

The control system or the light bulbs themselves can monitor the health of all the bulbs in the system. The health monitoring may include monitoring whether or not the bulb is still functional, or if the specified number of hours of usage is being approached. When a bulb or bulbs are in need of replacement, the user will be alerted by the system that a certain number of new replacement bulbs need to be procured. Depending on the level of connectivity or automation of the users overall system, replacement bulbs could be automatically ordered.

Various embodiments will now be discussed in greater detail with reference to the accompanying figures, beginning with FIG. 1A.

FIG. 1A illustrates a diagram of an overview of a system 100 to facilitate electric lighting device health management, in accordance with certain embodiments of present disclosure. For brevity, system 100 is depicted in a simplified and conceptual form, and may generally include more or fewer systems, devices, networks, and/or other components as desired. Further, the number and types of features or elements incorporated within the system 100 may or may not be implementation-specific. The system 100 may correspond to a smart light system.

The system 100 may include one or more smart light assemblies 105 adapted for connection to one or more power sources 110. Various embodiments may be directed to various types of electric lighting devices. The illustration of FIG. 1 depicts a single smart light assembly 105 for the sake of brevity. The smart light assembly 105 may include an electric light source 115 and a receptacle 160 adapted to receive the electric light source 115. The assembly 105 may include and be electrically connected to the power source 110 with multiple conductors such as line and neutral conductors. In various embodiments, the electric light source 115 may correspond to any suitable electric light, such as a smart light bulb, an LED light, a CFL light, and/or the like.

In some embodiments, the receptacle 160 adapted to receive the electric light source 115 may correspond to a light socket. In various embodiments, the receptacle 160 may be any suitable electrical connector that allows the electric light source 115 to be connected to a power source 110. In a common case, the example depicted may correspond to receptacle 160 adapted for electrical connection to an AC power source 110. Alternative embodiments could be directed to any one or combination of another type of electric light assembly of any suitable shape, size, and connector type, a DC power configuration, and/or any suitable voltage rating. Types of smart light assemblies 105 may be implemented according to particular national standards in certain embodiments.

The smart light assembly 105 may be configured to be self-aware. For example, the smart light assembly 105 may provide for health-monitoring so that the smart light assembly 105 may be self-aware with respect to its own health. The smart light assembly 105 may include a health monitor adapted to be disposed in the smart light assembly 105. With the health monitor, the smart light assembly 105 may monitor sensor data with respect to operations of the smart light assembly 105. Based at least in part on monitoring the sensor data, the smart light assembly 105 may monitor one or more conditions of at least a portion of the electric light assembly 105. The smart light assembly 105 may be configured to store data recordings corresponding to its operations over a period of time. Additionally, the smart light assembly 105 may be configured to create reporting data based at least in part on the stored data recordings. The smart light assembly 105 may be further configured to wirelessly transmit communications toward one or more remote devices and/or systems. Such communications may include the reporting data in some embodiments.

Various embodiments of the smart light assembly 105 may include a health monitor in various components of the smart light assembly 105. In some embodiments, the electric light source 115 may be any suitable commercially available electric light. Yet, in other embodiments, the electric light source 115 may be a smart light that includes a health monitor in accordance with certain embodiments of the present disclosure. The smart light source 115 in such embodiments may be adapted for insertion into conventional receptacles—e.g., the smart light may be screwed into a conventional receptacle. Thus, the smart light source 115 may be may be adapted in size, shape, and/or function to be easily installed and used with existing light receptacles.

Hence, in some embodiments, the receptacle 160 may be any suitable commercially available receptacle adapted to receive the light source 115, which may include an end portion formed to mate with conventional sockets. Yet, in other embodiments, the receptacle 160 may be a smart receptacle that includes a health monitor in accordance with certain embodiments of the present disclosure. The smart receptacle 160 may be implemented in lieu of the conventional receptacle and may be adapted to receive the electric light 115 (e.g., a light bulb that may be screwed into the smart receptacle 160). Thus, the smart receptacle 160 may be may be adapted in size, shape, and/or function to be easily installed and used with existing light sources.

Figure 1B:
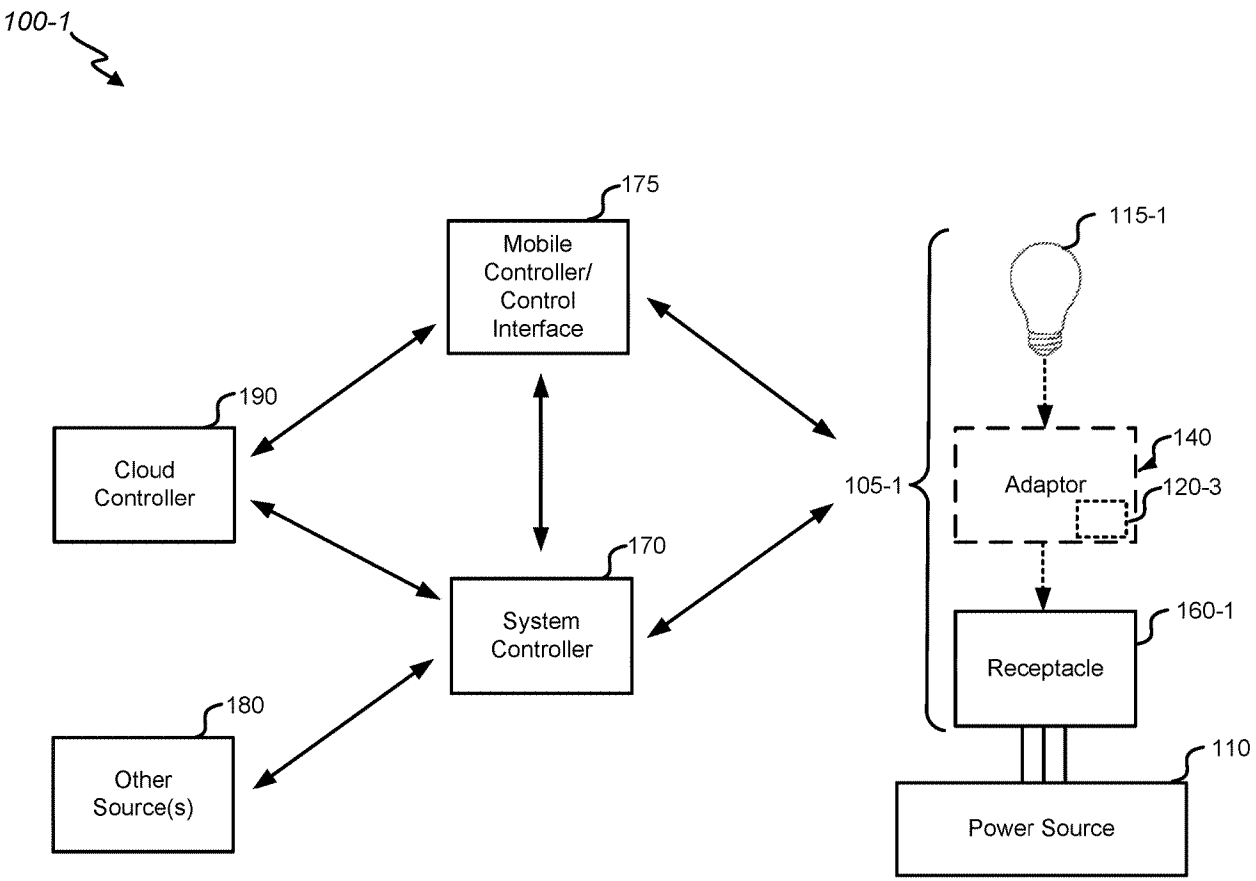
FIG. 1B illustrates a diagram of an overview of a system to facilitate electric lighting device health management, in accordance with certain embodiments of present disclosure.

However, in other embodiments, both the light source 115 and the receptacle 160 may be any suitable commercially available electric light and receptacle, respectively. With such instances, certain embodiments may include a smart adaptor 140 configured to couple the light source 115 and the receptacle 160. FIG. 1B illustrates a diagram of an overview of a system 100-1 to facilitate electric lighting device health management, in accordance with certain embodiments of present disclosure. In contrast to FIG. 1A, FIG. 1B depicts a smart light assembly 105-1 that includes the smart adaptor 140. The adaptor 140 may include a health monitor in certain embodiments. The smart adaptor 140 may, for example, correspond to a smart receptacle configured as an extension of a conventional receptacle, that may be inserted in the conventional receptacle (e.g., screwed into the conventional receptacle) with an end portion, including a terminal, formed to mate with a conventional receptacle as would a light source 115. The opposing end of the adaptor 140 may have an end portion, including a terminal, formed to receive a conventional light source (e.g., a light bulb that may be screwed into the smart adaptor 140) as would a conventional light socket. Thus, the smart adaptor 140 may be may be adapted in size, shape, and/or function to be easily installed and used with existing electrical fittings.

The system 100 may include a system controller 170. The system controller 170 may be configured to manage the one or more smart light assemblies 105. The system controller 170 may provide a link if necessary between the communication protocol used by a light monitor 120 (disclosed further herein in reference to FIG. 3) and the communication protocol used by any mobile controller 175. In some embodiments, this may be a bridge, for example, between two or more of ZigBee, Z-Wave, RF4CE, Bluetooth, Wi-Fi, and/or the like. In some embodiments, the system controller 170 may be integrated within a set-top box, a television, or another household device.

The system controller 170 may provide a user interface to allow for output of information to a user and for input from user with one or more user-selectable options. In various embodiments, an end-user interface may include providing one or more display screens that may each include one or more user interface elements. An end-user interface may include any text, image, and/or device that can be displayed on a display screen for providing information to a user and/or for receiving user input. An end-user interface may include one or more icons, widgets, buttons, checkboxes, text, text boxes, text fields, tables, lists, and/or the like.

The system controller 170 may contain schedules and timers for when light sources 115 should be turned on, turned off, dimmed, configured to operate in a power savings mode, etc. It provides a means for creating more detailed interaction between devices. In some embodiments, system controller 170 may include the option for inputs from one or more other sources 180. For example, an external light sensor may be used as a trigger to turn on certain lights around the house. As another example, a temperature sensor may be used as trigger to activate/deactivate certain light sources 115. A power configuration could designate a temperature threshold such that the operation mode(s) for one or more light sources 115 would be initiated when an inside temperature and/or an outside temperature in the location meets or exceeds the temperature threshold. For examples, light sources 115 could be controlled to minimize operations during a hot time of day, etc. The one or more other sources 180 could include any suitable sensor or other data source, which could be network-accessible, such as a service provider or private/public data source.

The system 100 may include one or more mobile controllers/control interfaces 175. In some embodiments, a mobile controller/control interface 175 may include a switching component configured to actuate a device under control. For example, the switching component may include a wireless light switch configured to actuate one or more light assemblies 105. Additionally or alternatively, a mobile controller/control interface 175 may include a computing device configured with a control application. The computing device may include a tablet, smartphone, PC, laptop, set-top box, television, and/or any other computing system or device. In some embodiments, control may be allowed from multiple devices around the home interfacing to the system controller 170. The system 100 may also allow control from outside of the home, in this case control is likely to be routed by way of servers in the cloud by way of a cloud controller 190. To facilitate operational maintenance actions, various embodiments of the controllers 170, 175 and the light assemblies 105 may provide one or more interfaces that: receive electronic communications from one or more smart light assemblies, transmit electronic communications to one or more smart light assemblies, transmit electronic communications to one or more end-user devices, receive electronic communications from one or more end-user devices, transmit electronic communications to one or more resource-controlling systems (e.g., an online service provider), receive electronic communications from one or more resource-controlling systems, and/or the like.

As disclosed above, the light assembly 105 may be configured to monitor operations of the light source 115, and to wirelessly transmit communications, which may include reporting data, toward one or more remote devices and/or systems. In some embodiments, the electronic communications may be directed toward the system controller 170 and/or one or more mobile controllers 175. In some embodiments, the light assembly 105 may be individually controlled with a control application on the system controller 170 and/or the one or more mobile controllers 175. With some such embodiments, the light assembly 105 may wirelessly transmit the communications directly to the system controller 170 and/or the one or more mobile controllers 175. With other embodiments, the light assembly 105 may wirelessly transmit the electronic communications indirectly to the system controller 170 and/or the one or more mobile controllers 175, via one or more other light assemblies 105 and/or one or more other communicably coupled devices.

The system controller 170 and/or the one or more mobile controllers 175 may monitor electronic communications, received via one or more interfaces, from the light assemblies 105 to identify light-usage durations and/or times. In some embodiments, the system controller 170 and/or the one or more mobile controllers 175 may update a usage-patterns data store 326 to associate each of the light assemblies 105 with usage data based at least partially on one or more of the identified light-usage durations. Some embodiments of the system controller 170 and/or the one or more mobile controllers 175 may further associate the identified light-usage durations with health records for each of the light assemblies 105. With some embodiments, the system controller 170 and/or the one or more mobile controllers 175 may detect a location associated with each electronic communication from one or more light assemblies 105 in order to identify a location of each of the one or more light assemblies 105. With some embodiments, the electronic communications monitored by the usage monitor of the system controller 170 and/or the one or more mobile controllers 175 may include sensor data from sensors associated with the light assemblies 105. The usage monitor may update the usage-pattern data store 326 at least in part based on the particular type of sensor data detected.

Figure 2A:
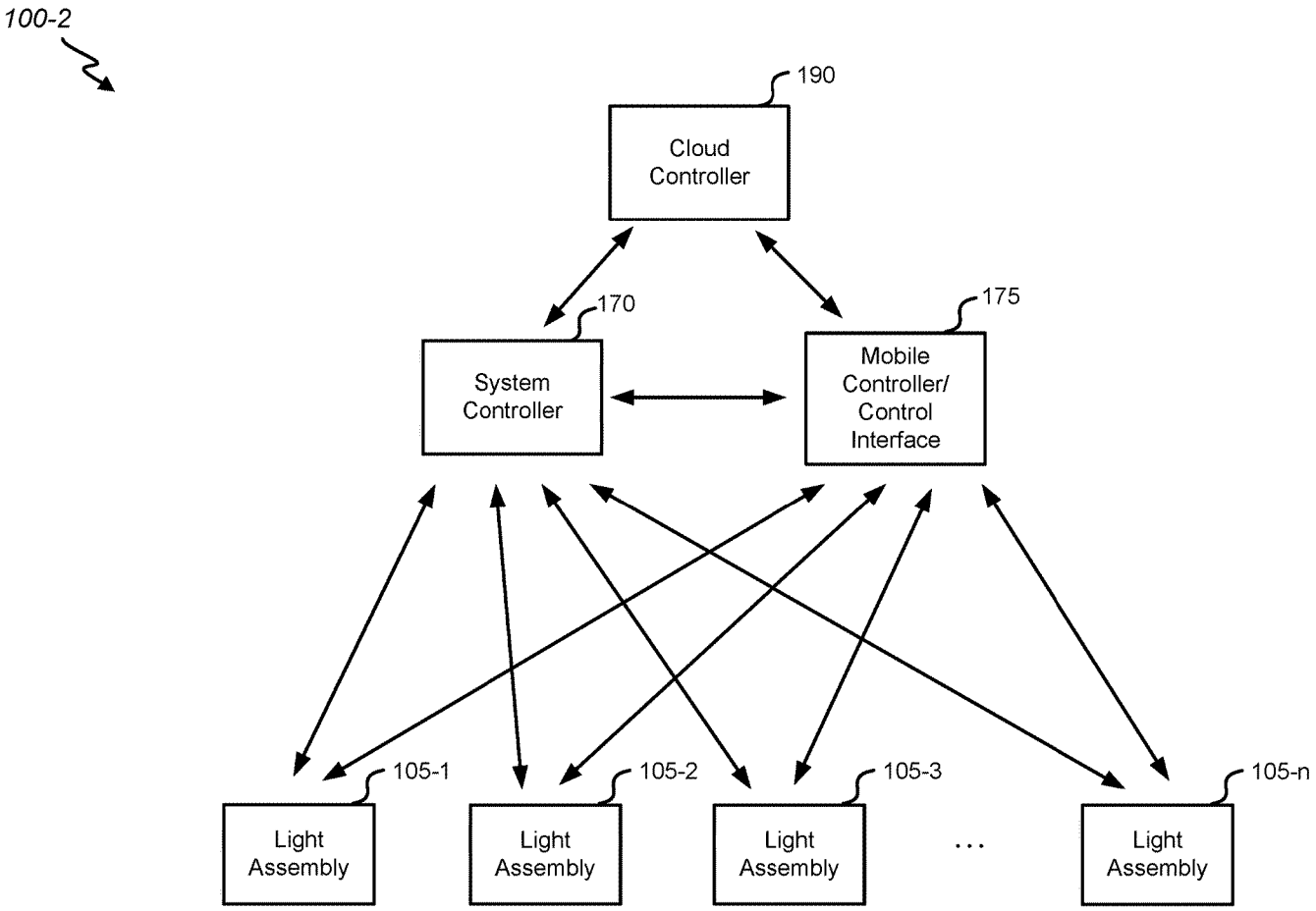
FIG. 2A illustrates a diagram of an overview of a system to facilitate electric lighting device health management with a plurality of light assemblies communicatively interconnected according to a wireless central hub/control system topology, in accordance with certain embodiments of present disclosure.

Various embodiments may include a plurality of smart light assemblies. In such embodiments, the plurality of smart light assemblies may be communicatively interconnected according to various topologies according to various embodiments. FIG. 2A illustrates a diagram of an overview of a system 100-2 to facilitate electric lighting device health management with a plurality of light assemblies 105 communicatively interconnected according to a wireless central hub/control system topology, in accordance with certain embodiments of present disclosure. Communications from the light assemblies 105 in the system 100-2 may be transmitted directly to the system controller 170 and/or the one or more mobile controllers 175. Likewise, communications from the system controller 170 and/or the one or more mobile controllers 175 may be transmitted directly to the light assemblies 105.

Figure 2B:
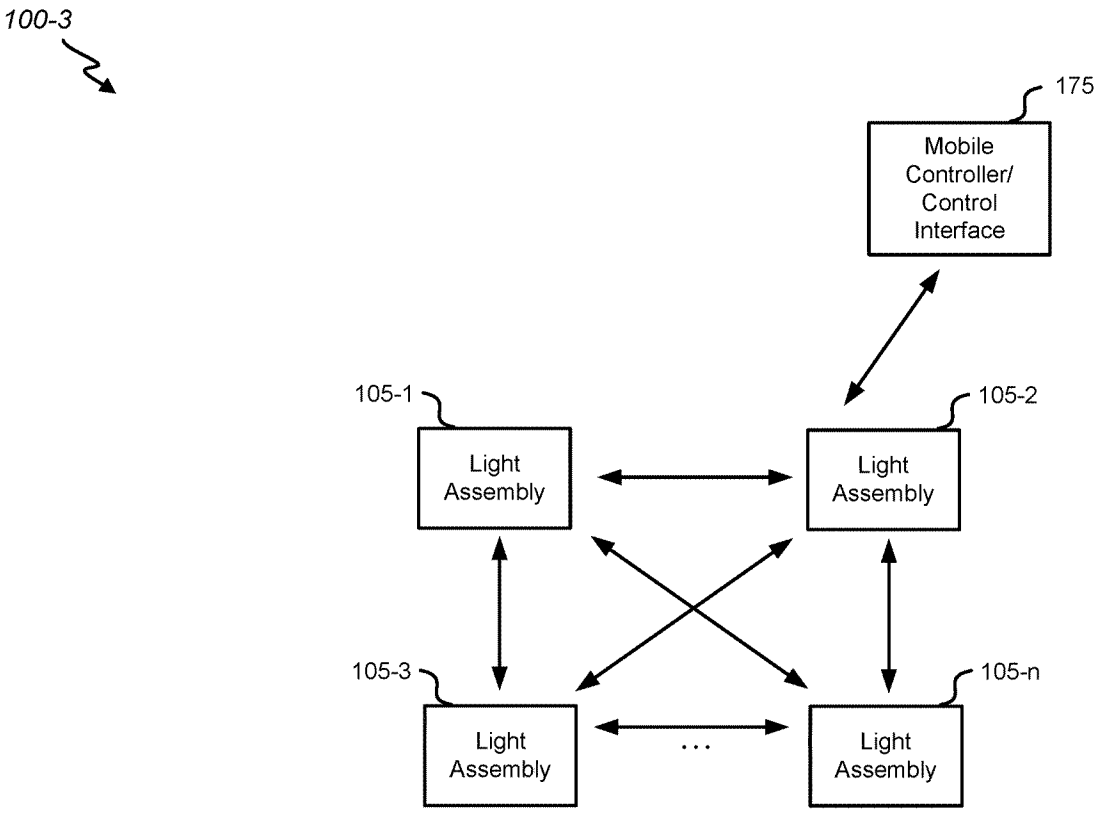
FIG. 2B illustrates a diagram of an overview of a system to facilitate electric lighting device health management with a plurality of light assemblies communicatively interconnected according to a wireless mesh network topology, in accordance with certain embodiments of present disclosure.

However, in some embodiments, the plurality of light assemblies 105 may be communicatively interconnected according to a wireless mesh network topology. FIG. 2B illustrates a diagram of an overview of a system 100-3 to facilitate electric lighting device health management with a plurality of light assemblies 105 communicatively interconnected according to a wireless mesh network topology, in accordance with certain embodiments of present disclosure. Communications from particular light assemblies 105 in the system 100-3 may be transmitted directly to one or more other light assemblies 105. In some embodiments, such communications may be ultimately passed to the system controller 170 and/or the one or more mobile controllers 175. The plurality of light assemblies 105 may be configured according to a hierarchy, in some embodiments. Such a hierarchy could be a tree hierarchy with some embodiments. Each light assembly 105 may be configured as a communication point for a certain number of other light assemblies 105. The hierarchy could be explicitly defined by the controller, or the hierarchy could be organically developed by the light assemblies 105. For example, a hierarchy may be formed such that each of the light assemblies 105 is configured to communicate with its nearest neighbor light assembly 105. Communications may be passed, based at least in part on proximity, to one or more nearest neighbor assemblies 105 until communications are passed to either the system controller 170 or a router for direction to a mobile controller 175. As another example, a hierarchy may be formed organically based at least in part on when individual light assemblies 105 are added to the system 100-3.

Some embodiments may employ a hybrid hub-spoke and meshed network topology. The hybrid topology may solve the problem of one or more light assemblies 105 being located too far away from the system controller 170 and/or the one or more mobile controllers 175 to communicate directly with the controller(s) (i.e., "remote light assemblies"), whereas one or more other light assemblies 105 may be located closer to the controller(s) such that those light assemblies 105 may communicate directly with the controller(s) (i.e., "proximate light assemblies"). The remote assemblies may be configured to broadcast or specifically direct communications to one or more other assemblies until the communications are either relayed by a proximate assembly or received by a controller. In some embodiments, the controller may receive multiple instances of a communication relayed from a remote assembly and may be configured to ignore redundant instances of the communication from the remote assembly.

A set of communication protocols may facilitate communications between the light assemblies 105 and the system controller 170 and/or the mobile controller(s) 175. The communication protocols may be based upon particularized message structures. By way of example, message protocols may apply to notifications from a given light assembly 105. A message protocol may include any one or combination of a system ID field for a system identifier, light assembly ID field for an assembly identifier, a location ID field for a location identifier of a location corresponding to the particular light assembly 105, a light status for a status indicator corresponding to the particular light (e.g., operational status such as on/off, health status such as indicia disclosed further herein, and/or the like), a light log field for reporting data such as that disclosed further herein, an operational control field for operational control specifications (e.g., timer schedules, health monitoring thresholds, and/or the like), a notification field for notifications disclosed further herein, and/or the like. In some embodiments, message protocols may apply to commands from the system controller 170 and/or the mobile controller(s) 175. Such a message protocol may include any one or combination of a system ID field for a system identifier, light assembly ID field for an assembly identifier, a location ID field for a location identifier of a location corresponding to the particular light assembly 105, a query field for specifying a query command and requested reporting data, log data, status indicator, operational control information, and/or the like, an operational control field for operational control specifications (e.g., timer schedules, health monitoring thresholds, and/or the like), and/or the like. In various embodiments, additional commands, response, interrupts, and sequences may be added. Any suitable standardized protocols may be employed in various embodiments. In some embodiments, the protocols may call for a system identification information and/or device identification information with each message.

Figure 3:
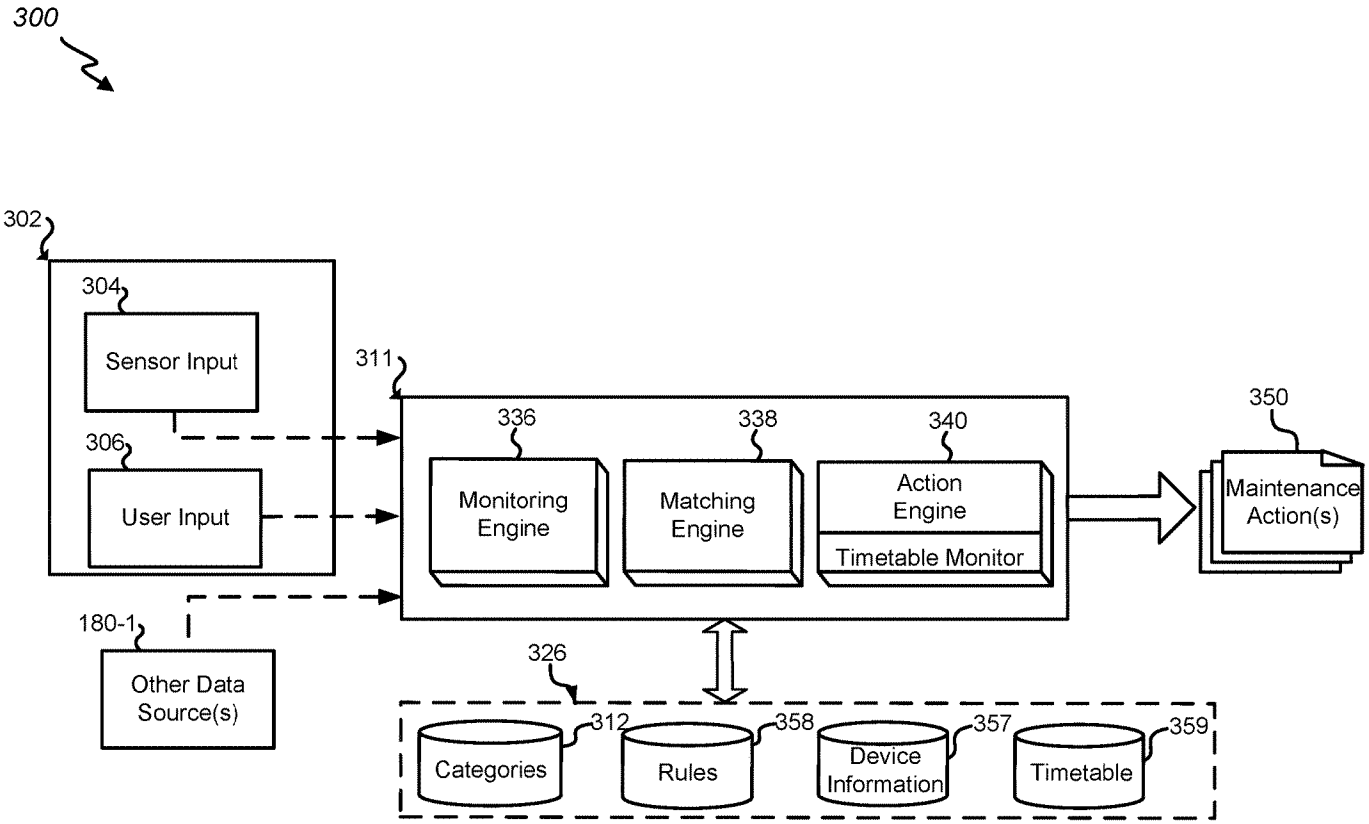
FIG. 3 illustrates a functional diagram of a subsystem for facilitating electric lighting device health management, in accordance with certain embodiments of the present disclosure.

FIG. 3 illustrates a functional diagram of a subsystem 300 for facilitating electric lighting device health management, in accordance with certain embodiments of the present disclosure. In some embodiments, the subsystem 300 may correspond to aspects of the system controller 170 and/or the mobile controller(s) 175 in conjunction with the one or more light assemblies 105. As depicted, the subsystem 300 includes a health management engine 311, which, in various embodiments, may correspond to the system controller 170, the mobile controller(s) 175, and/or the individual one or more light assemblies 105. The health management engine 311 may be communicatively coupled with interface components and communication channels (e.g., the system controller 170, the mobile controller(s) 175, and/or the individual one or more light assemblies 105) configured to receive lighting device input 302.

As depicted, the lighting device input 302 may include sensor input 304. The sensor input 304 may be captured by the sensor devices of the one or more light assemblies 105 disclosed herein. The health management engine 311 may include a monitoring engine 336 configured to monitor the lighting device input 302 for any suitable aspects pertaining to the one or more light assemblies 105. For example, the monitoring engine 336 may process reporting data, notifications, and/or other information enabling unique identification of light assemblies 105 and lighting source 115 states and characteristics disclosed herein. Accordingly, in various embodiments, the system controller 170 and/or the one or more mobile controllers 175 and/or the light assemblies 105 themselves may monitor the health of all the light sources 115 in the various systems. The health monitoring may include monitoring whether or not a particular light source 115 is still functional, monitoring if one or more thresholds of usage (e.g., numbers of hours usage) are being approached and/or satisfied, and/or monitoring other aspects as disclosed further herein.

The health management engine 311 may include a matching engine 338. In some embodiments, the matching engine 338 can receive sensor data corresponding to one or more lighting sources 115, identify attributes of the one or more lighting sources 115 based at least in part on the sensor data and the device information 357, and match the one or more lighting sources 115 to one or more categories from a category information repository 312. The device information 357 may include information stored for particular light assemblies of the system. By way of example, the device information 357 may include device profiles for particular light sources, which profiles may include device identifiers, corresponding location identifiers, model information for the light sources, history information for the light sources such as installation date/time and historical usage data, expected life balance, predicted end of life, and/or the like. Captured lighting source reporting data may be correlated to device information 357 using any one or combination of device identifiers, corresponding location identifiers, model information for the light sources, and/or the like. The matching engine 338 may be configured to match particular lighting source 115 data to device information 357 retained for light assemblies of the system. For example, the matching engine 338 may link particular lighting device input 302 to one or more device profiles with stored in the device information data store 357 to identify a known lighting sources 115 or a new lighting source 115 and update or create a corresponding device profile.

The matching engine 338 may be configured to match particular lighting source 115 information captured via the monitoring engine 336 to one or more categories from a set of categories 312. Any suitable category may be employed to facilitate device management features in accordance various embodiments. By way of example, category information may include categories and corresponding criteria to qualify for particular categories such as new device, functional, light use, heavy use, early life stage, mid-life stage, end-of-life stage, end-of-life imminent, non-functional, over-voltage exposure (e.g., home electrical wiring problems may be detected), under-voltage exposure (again, electrical problems may be detected), overheated situation (e.g., when light bulb is rated for too high a wattage for a glass or other light enclosure such that heat does not escape at a sufficient rate, or when a recess enclosure likewise does not allow sufficient heat escape), cold temperature mismatch situation (e.g., an indoor rated bulb installed outdoors and exposed to cold outside temperatures) and/or the like. In some embodiments, the rules 358 may include criteria for matching a set of indicia of lighting sources 115 states and characteristics to a set of one or more categories. In some embodiments, the rules 358 may include criteria for matching a set of one or more categories to a set of one or more maintenance actions.

Having captured data, the monitoring engine 336 may implement one or more device assessment processes. The one or more individual device assessment processes may include one or more metric analysis processes to determine a health assessment of an individual light source 115. Lighting device data can be consolidated and processed to yield a light source 115 health score. Some embodiments may qualify an individual light source 115 according to a graduated health assessment scale. Any suitable health assessment scale may be used in various embodiments. In some embodiments, a health assessment scale could entail a categorization scheme 312, with categories such as examples noted above. In some embodiments, the health assessment scale could entail a light source 115 health scoring system. The individual light source 115 health scores could be correlated to the category scheme in some embodiments, such that certain scores correspond to certain categories. Some embodiments may score a light source 115 with a numerical expression, for example, a light source 115 health score.

By way of example, one scale could include a range of light source 115 health scores from 0 to 100, or from 0 to 1,000, with the high end of the scale indicating greater device health. Some embodiments may use methods of statistical analysis to derive a light source 115 health score. A score may be determined based at least in part on comparing recorded device usage to a life expectancy specified (e.g., in hours) for the device. With recorded device usage and the life expectancy, the health management engine 311 may calculate an expected life balance for the light source 115 and assign a corresponding score to the light source 115.

A device profile for a particular light source 115 may include light specifications for the light source 115 (e.g., a life expectancy specification, model information, light type, light ratings, and/or the like). The light specifications may, in some cases, be system-determined. In some embodiments, the light monitor 120 and/or controllers 170, 175 may be preset by, say a manufacturer and/or service provider, with the one or more light specifications. In some embodiments, the light source 115 may include a health monitor 120 that is self-aware such that the light source 115 stores its light specifications. In those cases and in embodiments where the subsystem 300 is incorporated in the light source 115 itself, the light specifications are already known to the health management engine 311. However, in embodiments where the health management engine 311 is not included in the light source 115 (e.g., where the health management engine 311 is included in a system or mobile controller), the light specifications may be communicated from the light source 115 to the health management engine 311. In some embodiments, the controller 170, 175 may pull that information from the light source 115.

In other embodiments, the controller 170, 175 may pull light specifications for particular models from remote data sources, such as online data sources 180. For example, the controller 170, 175 may search the online data sources 180 with one or more queries made via one or more networks. In some cases, the queries maybe directed to vendors of the light sources 115. In some cases, the queries may be directed to an online aggregator of light source product information, for example, a service provider associated with the controller 170, 175. In some cases, product specification information may be gathered from an online vendor with each replacement order made by the controller 170, 175 and lights specifications may be recognized by the controller 170, 175 from the product specification information provided by the online vendor.

In some cases, user input 306 may specify light specifications. The end user could have the option to define and/or select one or more light specifications via controllers 170, 175 in some embodiments. In other cases, the light specifications for a given light source 115 may not be immediately obtainable by the controller 170, 175. In such cases, the controller 170, 175 may estimate light specifications. The health management engine 311 may monitor the operational characteristics of particular light sources 115—for example, the power draw of the light source 115. Some embodiments may allow for matching unknown lighting sources 115 with other lighting sources 115. For example, it may be determined whether one or more of the operational characteristics of an unknown lighting source 115 match operational characteristics of another already recognized lighting source 115. The one or more characteristics can be compared with those of another, already recognized lighting source 115, and, if the one or more characteristics matched within a tolerance threshold (say, a tolerance of plus or minus 1%, 5%, or any other suitable tolerance), the unknown lighting source 115 can be determined to match with the light specifications (and/or category) of the second lighting source 115. Then, the lighting source 115 can be mapped to the light specifications (and/or category) of the already recognized lighting source 115.

A score may be determined based at least in part on comparing recorded device usage to a life expectancy specified (e.g., in hours) for the device. With a health score determined, categorizations may be made based on the score. By way of example without limitation, a score correlated to a 75-100% band may be categorized as early life stage; a score correlated to a 50-75% band may be categorized as a mid-life stage; a score correlated to a 25-50% band may be categorized as an end-of-life stage; a score below a 50% minimum threshold may be categorized as an end-of-life imminent stage; and score of zero may correspond to a non-functional or absent light source 115. Other categorizations and correlations may be used in various embodiments.

Additionally, in some embodiments, a score may be may be adjusted by the health management engine 311 taking into account other detected attributes of a particular light source 115. For example, if an over-voltage exposure situation is detected, the score may be decreased to account for the shortened lifespan that an over-voltage situation may cause. Similarly, if an under-voltage exposure situation, an overheated situation, or cold temperature mismatch situation is detected, the score may be decreased to account for the shortened lifespan that those situations may cause. Consequent to such situations being detected, certain embodiments may also send notifications of the situations to a controller 170, 175 and/or a user account (e.g., an email account) which is user-specified.

In various embodiments, the matching engine 338 may generate, develop, and/or otherwise use device profiles 357 based at least in part on input 402 over time. The matching engine 338 may include a reasoning module to make logical inferences from a set of the detected and differentiated data to infer one or more patterns of operational performance for particular light sources 115 in various locations on the premises. A pattern-based reasoner could be employed to use various statistical techniques in analyzing the data in order to make inferences based on the analysis. A transitive reasoner may be employed to infer relationships from a set of relationships related to compiled data. For instance, the matching engine 338 may compare detected lifespans of certain light sources to rated life expectancies for the light sources to identify consistencies between actual lifespans and rated life expectancies, inconsistences between actual lifespans and rated life expectancies, actual tolerances where actual lifespans are within (or not within) a certain tolerance with respect to rated life expectancies, and/or the like.

The matching engine 338 may determine patterns for individual locations. The health management engine 311 may surface information indicative of the pattern via a user interface and/or notifications. Likewise, the health management engine 311 may send alerts regarding anomalies with respect to patterns. For example, the matching engine 338 may determine light sources in a given location have only a 50-60% actual life span in a given location. The matching engine 338 may determine that that life span deficiency is independent of (or dependent on) the type, model, and/or rating of light sources used in that location. Thus, the matching engine 338 may identify problem areas in an electrical system for a certain premises.

Say, for example, that the matching engine 338 determines that, regardless of the type, model, and/or rating of light source used in that location, light sources consistently underperform with respect to rated lifespans, hence the matching engine 338 may identify a potential electrical problem. The matching engine 338 may corroborate such identification when the matching engine 338 detects under-voltage exposure situations, overheated situations, cold temperature mismatch situations, and/or the like. In the absence of such detected situations, the health management engine 311 may generate a trouble-shooting for a user to trouble-shoot a given problem area. For example, such a workflow may query the user through the user interface as to whether the given problem area is a high-vibrational environment, such as a fixture located under a stairway, and, upon user confirmation of such a situation with user selection of one or more user-selectable options, the workflow may generate one or more recommendations for light sources suited for high-vibrational installation environments.

As another example, the matching engine 338 may determine that the type, model, and/or rating of light sources can be optimized and may generate recommendation notifications for a user as to which type, model, and/or rating performs best for a given location. As yet another example, the matching engine 338 may develop and compare device profiles for identical light sources in various locations throughout the premises in order to derive conclusions based at least in part on the gathered data. The matching engine 338 may develop aggregate profiles that take all the light sources into account and may statistically analyze the operations of the light source to assess performance, derive performance characteristics, identify outliers, determine locations where the light source perform better or worse than others in other locations, and/or the like. Thus, the device information 357 may include pattern data and statistically derive conclusions and characteristics, and may include information about any one or combination of device histories, location histories, operational histories, temporal histories, and/or the like, any set of which may be used to derive one or more operational patterns for particular light sources and/or locations of a given premises.

The health management engine 311 may include an action engine 340 which may be configured to cause one or more maintenance actions. In some embodiments, the action engine 340 may analyze input monitored by the monitoring engine 336, determinations of the matching engine 338, and/or information stored in the one or more repositories 326 to make maintenance action determinations, which may include the health management engine 311 mapping one or more task types as actionable regarding one or more light sources 115. The health management engine 311 may identify an alteration condition regarding one or more light sources 115, such as a change in operations that satisfies one or more thresholds. Such changes may include an increase in detected usage hours such that the accumulated for one or more light sources 115 satisfies one or more thresholds. Such changes may include a corresponding change in one or more health scores and/or operational categories. Such changes may include a change in operational status (e.g., a light source is no longer detected as functional with a monitored pulse and/or test schedule effected by the health monitor 120). The health management engine 311 may identify one or more task corresponding to the identified one or more task types. Based at least in part on one or more maintenance action determinations, the action engine 340 may cause activation of one or more maintenance actions 350 that correspond to one or more determined tasks.

In various embodiments, one or more maintenance actions 350 may facilitate or be at least partially autonomous maintenance actions. For example, the health management engine 311 may transmit a notification to one or more end-user devices previously associated with the system. In addition or in alternative, notifications may be presented at the controllers 170 and/or 175.

As another example, the health management engine 311 may transmit updates of power usage, other metrics, indicia of detected situations, and/or the like to the one or more end-user devices. In various embodiments, the notifications may take the form of email notifications, push notifications, text message notifications, pop-up windows, modal windows, and/or the like which may be sent to the controller 170 and/or 175 and/or an account linked with the system. In some embodiments, the notification to the one or more end-user devices may include a task-performance duration. The notification may further facilitate the one or more end-user devices to perform a correspond task, such as place an order for one or more replacements with a resource-controlling system via one or more networks. To facilitate the task performance, the notification may include a user-selectable option a specify to ordering one or more replacements light sources 115 with a resource-controlling system, such an online vendor that may be one of the sources 180 available via one or more networks. In some cases, the user-selectable option may include a URL specific to the replacement resource available from the resource-controlling system.

As yet another example, the health management engine 311 may place an order for one or more replacements with a resource-controlling system via one or more networks. As disclosed above, with certain embodiments, the communications from one or more smart light assemblies 105 may include various commands in various embodiments. For example, in some embodiments, a command may correspond to a request to order one or more replacements for the light source 115 after the smart light assembly 105 has analyzed its data recordings with respect to one or more operational thresholds and determined that there is (or will be) a need for a replacement. The request to order may be directed to a controller 170, 175 in some embodiments. The controller 170, 175 may in turn transmit a notification to one or more end-user devices previously associated with the system and/or place an order for one or more replacements with a resource-controlling system via one or more networks. With other embodiments, the request to order may be directed to a resource-controlling system via one or more networks, such that the smart light assembly 105 directly places a replacement order.

Certain embodiments may further provide for intelligent timetable management. A timetable monitor may be included in the action engine 340 in some embodiments and, in other embodiments, may be separate from the action engine 340. The timetable monitor may update one or more timetables in a timetable data store 359, which may be included in the device information repository 357 in some embodiments, but, in other embodiments, may be separate. In some embodiments, the timetable monitor may monitor electronic communications, received via one or more interfaces, from one or more smart light assemblies 105, the controller 170, 175, and/or one or more remote resource-controlling systems. The timetable monitor may identify updates to timetables of smart light assemblies 105 and/or replacement orders. The timetables of smart light assemblies 105 may indicate assessments of usage, expected life balance, predicted end of life, and/or the like. The timetables of replacement orders may indicate lead time for replacement orders, buffer time for shipping after order placement, buffer time for restoring a light source (rather than assuming immediate restoration), and/or the like. The timetable monitor may update the timetables based at least partially on historically monitored actions.

Certain embodiments may further provide for replacement inventory tracking. The health management engine 311 may track quantities of replacements versus replacements used. For example, with embodiments where either the smart assembly 105 or the controller 170, 175 directly place a replacement order, the quantity of replacement lights ordered may be tracked in the timetable data store 359. The tracked quantity of replacement lights ordered may be added by the timetable monitor to a current inventory record upon reception of a delivery notification or after an estimated delivery time has passed. Further, burnt-out or otherwise non-functional lights may be logged. Installations of replacements of the burnt-out or otherwise non-functional lights may be detected. Such installations may be logged, and the current inventory record may be updated to decrement an estimated quantity of on-premise replacements.

Any suitable power usage and/or health metrics may be derived to indicate power usage and/or health assessments associated with any one or combination of operational modes. This may allow for the surfacing of power usage and/or health assessment information to an end user on a per-light source basis and/or on an aggregated basis. Power usage and/or health assessment information may be processed for any suitable time period. For example, comparisons current and past power usage and/or health assessment information may be surfaced to an end-user interface on a per-light source basis and/or on an aggregated basis. Indicia of health assessments may include health scores, health bars, timetable information from the timetables, bar graphs, pie charts, numerical indicators, textual descriptions, and/or any other suitable graphical indicia.

In various embodiments, the one or more information repositories 326 may be implemented in various ways. For example, one or more data processing systems may store information. One or more relational or object-oriented databases, or flat files on one or more computers or networked storage devices, may store information. In some embodiments, a centralized system stores information; alternatively, a distributed/cloud system, network-based system, such as being implemented with a peer-to-peer network, or Internet, may store information. The information repositories 326, which may include category information repository 312, rules repository 358, device information repository 357, and timetable information repository 359 may retain any suitable information to facilitate certain features disclosed herein and may be separate or consolidated into on repository. By way of example, the one or more information repositories 326 may store user information that may include any one or combination of user account information, contact information (such as linked email account information, telephone information, etc.), notification preferences (such as whether the user has accepted email notifications, push notifications, text message notifications, etc. as means of relaying notifications), user account information with a resource-controlling system (such as an online vendor), light source information, and/or the like.

The system 100 may be configured to provide luminance self-adjustment features. The system 100 may detect actual luminance levels in particular locations, compare the detected luminance to one or more luminance specifications for the particular locations, determine one or more operational adjustments of one or more of the light assemblies 105 to conform to the one or more luminance specifications, and adjust operations of one or more of the light assemblies 105 in accordance with the one or more operational adjustments. As disclosed herein, embodiments of the light assemblies 105 and/or the controllers 180, 175 may include or otherwise be communicatively coupled to sensors, which may be light sensors. The light sensors may be disposed and/or shielded to detect light from external sources (e.g., light from light assemblies 105 other than the light assembly 105 including a given light sensor, so that the light sensor is sensitive to external light and not overwhelmed by the light of the light assembly 105).

With the light sensors, the light assemblies 105 and/or the controllers 180, 175 may gather data regarding luminance levels in particulars locations. Based on pattern recognition of luminance data gathered for areas proximate to the light sensors, the light assemblies 105 and/or the controllers 180, 175 may learn baseline luminance levels for the areas and may store specifications of the baseline luminance levels in a data store such as the usage-pattern data store 326.

Baseline luminance levels may also be user-specified, selected, and/or confirmed. For example, luminance data may be surfaced to a user via the controllers 180, 175, with user-selectable options to select luminance targets for particular locations, groups, and/or the system generally. The selected targets may be used as baselines.

Further, the pattern recognition may allow group-awareness such that the light assemblies 105 and/or the controllers 180, 175 may learn which light sources are frequently used (i.e., turned on/off) in groups (e.g., light sources on the same electrical circuit and/or light sources that are otherwise often turned on together by manual activation or user specification). One or more frequency thresholds may be applied to identify lighting groups (e.g., frequencies of activation such as 50% or more of the activation instances, or some other suitable threshold). Hence, the light assemblies 105 and/or the controllers 180, 175 may identify groups of the light assemblies 105 correlated with particulars areas and baseline luminance levels for the areas and may store specifications of such in a data store such as the usage-pattern data store 326.

In an ongoing monitoring mode, the light assemblies 105 and/or the controllers 180, 175 may continue to gather data regarding luminance levels in particulars locations and continually, periodically, or occasionally compare monitored area-specific luminance levels to the learned baseline luminance levels for the particular areas to identify deviations from the baseline levels. The light assemblies 105 and/or the controllers 180, 175 may correlate the detected deviations to light sources being burnt-out, otherwise non-functional, and/or non-optimally functional. Such correlations may be based at least in part on detected conditions of particular light assemblies 105. For example, a light assembly 105 may be configured to self-detect such deficiencies and may report the condition to one or more other light assemblies 105 and/or the controllers 180, 175. In some implementations, such a condition may be detected by one or more other light assemblies 105 and/or the controllers 180, 175 when the problematic light assembly 105 fails to send expected health communications, expected replies, and/or the like.

In a compensation mode, the light assemblies 105 and/or the controllers 180, 175, having identified a deviation, may identify one or more compensation actions to at least mitigate the deviation. The one or more compensation actions may be based at least in part on one or more conditions of one or more particular light assemblies 105. For example, if the one or more particular light assemblies 105 are detected to be operational, the light assemblies 105 and/or the controllers 180, 175 may cause the one or more particular light assemblies 105 to brighten to mitigate the deviation when the deviation is due to a luminance deficiency caused by one or more non-optimally functional light sources (or, in some cases, to dim to mitigate the deviation when the deviation is due to a luminance excess caused by one or more non-optimally functional light sources are too bright and cannot be dimmed). If the one or more particular light assemblies 105 are detected to be non-operational or limited in operation, the light assemblies 105 and/or the controllers 180, 175 may cause one or more other light assemblies 105 to dim or brighten to mitigate the deviation. The determination of which one or more other light assemblies 105 should be adjusted may be based at least in part on being identified as in the same group as the non-operational or limited one or more light assemblies 105. Additionally or alternatively, the determination of which one or more other light assemblies 105 should be adjusted may be based at least in part on being proximate to the non-operational or limited one or more light assemblies 105. Thus, a compensation action may correspond to adjusting the closest neighboring one or more light assemblies 105 that are the closest neighbors to and/or in the same group as the non-operational or limited one or more light assemblies 105.

Additionally or alternatively to the luminance self-adjustment features, the system 100 may be configured to provide energy-consumption self-adjustment features in a similar manner. As disclosed herein, embodiments of the light assemblies 105 may include or otherwise be communicatively coupled to sensors, which may be current and/or power sensors. The system 100 may detect actual energy-consumption levels in particular locations, compare the detected energy-consumption to one or more energy-consumption specifications for the particular locations or the system in the aggregate, determine one or more operational adjustments of one or more of the light assemblies 105 to conform to the one or more energy-consumption specifications, and adjust operations of one or more of the one or more of the light assemblies 105 in accordance with the one or more operational adjustments. Energy consumption data may be surfaced to a user via the controllers 180, 175, with user-selectable options to select energy-consumption targets for particular locations, groups, and/or the system generally. Hence, the user may select targets that may be used as baselines. The adjustment may be effected by brightening or dimming light assemblies 105 on a group basis and/or on a location basis in order to achieve a selected target.

Figure 4:
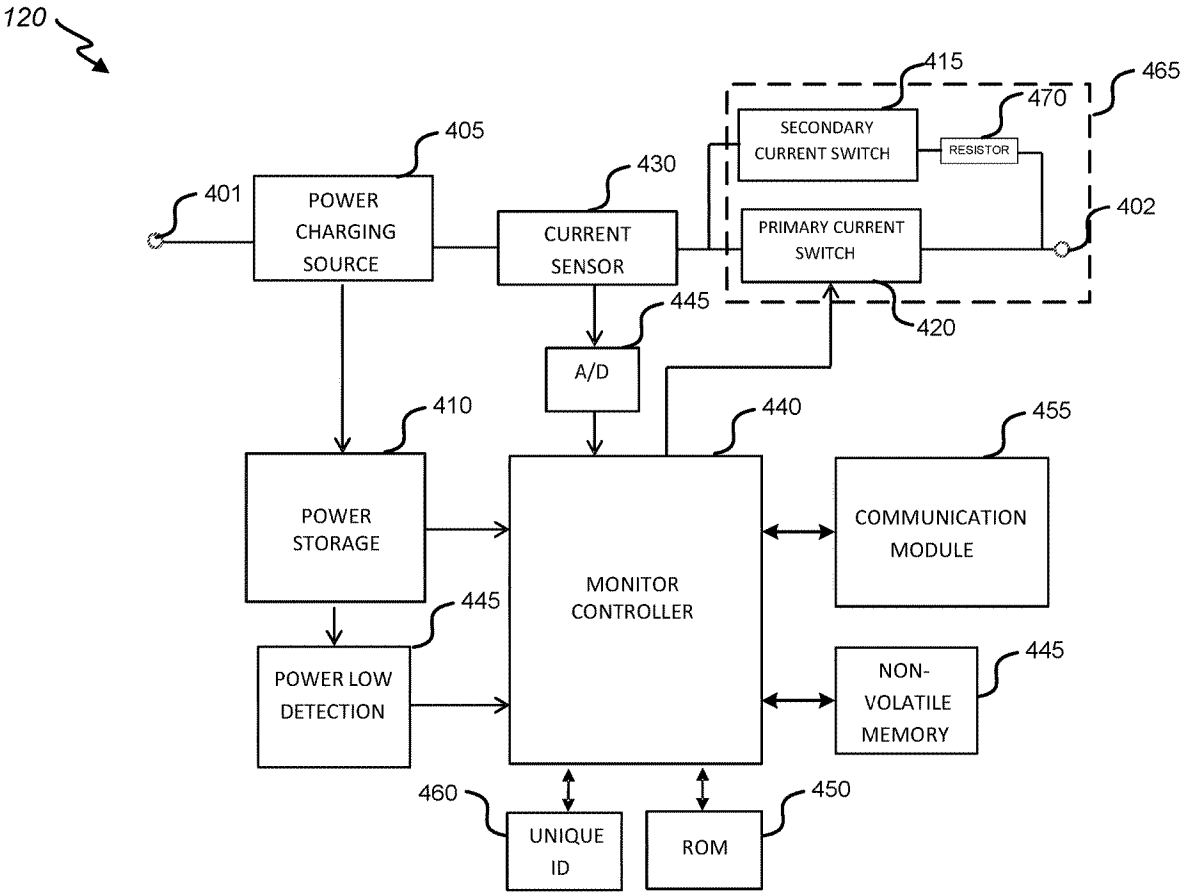
FIG. 4 illustrates a block diagram of a light monitor, in accordance with certain embodiments of present disclosure.

FIG. 4 illustrates a block diagram of a light monitor 120, in accordance with certain embodiments of present disclosure. The light monitor 120 may be adapted to be disposed within at least one of the various components of the light assembly 105, per the various embodiments disclosed herein (e.g., as illustrated by light monitors 120-1, 120-2, and 120-3 in FIGS. 1A and 1B). In some embodiments, the light monitor 120 may include one or more substrates (not shown), which could be a PCB or any other substrate suitable for carrying certain components of the light monitor 120. With some embodiments, the substrate and interior components may be at least partially surrounded by a housing of any suitable material. The light monitor 120 may include one or more integrated circuits. The integrated circuit could provide certain functionalities, such as one or more sensing functionalities, communication functionalities, switching functionalities, and/or the like.

The substrate may be connected to terminals 401, 402. The terminals 401, 402 may be electrically connected to conductors of the light assembly 105. In some embodiments, the terminals 401, 402 may be electrically connected to a power connector of the light assembly 105. For example, the terminals 401, 402 may be in series with line conductors of the light assembly 105, where the line conductors provide power from a power source. As another example, the terminals 401, 402 may be in parallel with line conductors of the light assembly 105.

The light monitor 120 may include a current sensor 430 configured to monitor the current flow to the light source 115. The current sensor 430 may use a low-impedance resistive element which generates a voltage across it proportional to the current flowing. This voltage may be converted using an A/D converter 435 or a similar converter into a digital representation. In addition to providing information relating to the instantaneous current flow, this may also allow synchronization of functionality with AC cycles. The A/D converter 435 may possess a high resolution to accommodate wide variation in load currents and to have fast response time. The output of the A/D converter 435 may be fed to the monitor controller 440.

Additionally or alternatively, some embodiments of the light monitor 120 may include one or more various other types of sensors. For example, some embodiments may include a thermal sensor configured to sense when the light source 115 is operating by way of detecting heat emanating therefrom. As another example, some embodiments may include a radiation/light sensor to sense when the light source 115 is operating by way of detecting light heat emanating therefrom.

The sensor may detect ambient temperature differences to infer when the light source 115 is operational and when it is not. Furthermore, the sensor may detect ambient temperatures to facilitate embodiments disclosed herein that identify cold temperature conditions (e.g., outdoor temperatures, which may be used to detect if a particular light source 115 is suitably rated for the colder ambient temperatures) and/or hot temperature conditions (e.g., to detect overheating conditions where the light source 115 may be in an enclosure or recess without sufficient ventilation for the produced heat to escape). Other embodiments are possible.

The monitor controller 440 may be the main intelligence responsible for monitoring and controlling actions of the light monitor 120. The monitor controller 440 may be powered by the power storage 410. The monitor controller 440 may include a microprocessor with programming instructions stored in any suitable form of non-volatile memory 445. The monitor controller 440 could include dedicated logic circuits programmed to detect and respond to defined input conditions. The monitor controller 440 may be configured to read the digital input values to determine the instantaneous current flow. The monitor controller 440 may gather data and send communications to the system controller 170 and/or the one or more mobile controllers 175, in accordance with various embodiments disclosed herein. The non-volatile memory 445 may retain recordings of the power usage. In some embodiments, the data may be stored for a sufficient time to allow for uploading of the data to the system controller 170 and/or the one or more mobile controllers 175 via a communication module 455.

The monitor controller 340 may send notifications to the system controller 170 and/or the one or more mobile controllers 175 according to various embodiments disclosed herein. To do so, the monitor controller 340 may utilize the communication module 455. The communication module 455 may include any one or combination of ZigBee, Bluetooth, Z-Wave, Wi-Fi, and/or the like RF communication modules which allow the light monitor 120 to communicate wirelessly with a central control point. In order to reduce the amount of data that must be sent, the values could be averaged over a period of time, in some embodiments. If the light source 115 is a static load, the frequency of reporting may be further reduced, in some embodiments. For example, reporting could be directed to instances when a change occurs. In the case of a microcontroller-based system, the non-volatile memory 445 may also store operating instructions, and/or they may be programmed in a read-only memory 450.

In addition, some embodiments the light monitor 120 may include a switching component 465. The switching component 465 may be electrically coupled to one terminal for electrical coupling to the light source 115. In some embodiments, the switching component 465 may include a primary current switch 420 and a secondary current switch 415. The switching component 465 may facilitate control of current flow to the light source 115. The primary current switch 420 can enable or disable power flow to the light source 115. The primary current switch 420 may include a suitable relay, semiconductor switch (e.g., a thyristor or TRIAC), and/or the like. In some embodiments, the primary current switch 420 may be configured to limit the flow of current and provide a dimming function by only switching the light source 115 on for a part of each cycle. By varying the point during the cycle when the device is switched on, the total power can be reduced. The light assemblies 105 may be otherwise configured to allow for dimming and brightening adjustments in any suitable manner.

The secondary current switch 415 may include a suitable relay, semiconductor switch (e.g., a thyristor or TRIAC), and/or the like. A resistive element 470 in series with the switch 415 may limit the current to lower amounts. The current would be limited to a value that is just sufficient to charge the storage cell 410. The resistive element 470 may be programmable in value with further switches to allow for the current to be varied depending upon the load. By allowing only a small current to flow initially, it may be possible to synchronize the switching of primary current switch 420 with the zero crossing point of the AC cycle. This may provide benefits in terms of reducing interference. This low-current mode may also be used to enable a background charging when the light source 115 is meant to be off. In some embodiments, the monitor controller 340 may manage local timers and schedules for the light monitor 120 so that it can continue to operate even when it loses communication with the system controller 170.

In some embodiments, it is necessary for the light monitor 120 to be controlled even when the light source 115 is switched off, hence it is necessary to maintain power in the light monitor 120. To that end, the light monitor 120 may include a power storage 410, which may correspond to the storage component 415. The light monitor 120 may include a power charging source 405 to enable charging of the power storage 410. When the light source 115 is turned on and current is flowing to the device 115, it is possible for the light monitor 120 to utilize the current flow and to recharge its internal power storage 410.

The power storage 410 may include one or more battery cells, one or more capacitors, and/or a similar charge storage device. The capacity of the power storage 410 may typically be such that, under normal operating conditions, the power storage 410 can be adequately refreshed whenever the light source 115 is operational. The power storage 410 may have sufficient capacity to power the light monitor 120 and allow for communications for long periods even when the light source 115 is switched off. Because of the differing light source 115 usage models in various implementations, different embodiments may be specified with different power storage 410 capacities to cope with different recharging regimes. Various embodiments of light monitors 120 may be optimized for constant switching on/off (e.g., daily usage, hourly usage, etc.) and/or for relatively long off periods (e.g., off periods which may last for a year or more).

The power charging source 405 may be configured to tap into the flow of current to the light source 115. In some embodiments, the power charging source 405 may cause a small amount of current to flow through a power generation circuit of the power charging source 405. In addition or in alternative, the power charging source 405 may take the whole current through a transformer circuit of the power charging source 405.

Due to the variability of the load current to the light source 115, the power charging source 405 may contain one or more sensing elements and one or more switchable elements so that, for instance, with a small load, more current is passed through the power storage circuit to charge the power storage cell 410. Thus, as the device load increases, a smaller proportion may be tapped. In the case when the device is switched off, the light monitor 120 may turn on the light source 115 momentarily for short periods such that the light source 115 is not activated.

In some embodiments, switching of the secondary current switch 415 may allow only a small current to flow. By allowing a small current to flow, this may be sufficient in itself to charge the power storage 410, in some embodiments. In this case, the power charging source 405 may be automatically reconfigured to operate from a lower current. In addition or in alternative, in various embodiments, the low current may allow the light monitor 120 to monitor the timing of the AC cycle and to switch the primary current switch 420 on in synchronization.

The light monitor 120 may include a power detector 425 configured to monitor the voltage being stored in the light monitor 120. The power detector 425 may detect when the voltage starts to drop so that it is possible to perform a background recharging of the power storage 410. The power detector 425 may be communicably coupled with the monitor controller 440. The light monitor 120 may also send a message to the system controller 170 when the power storage 410 is getting low and/or critically low so that the user may be informed. In some embodiments, the light monitor 120 may be configured to be powered directly from the AC connection with a connection to a neutral conductor, since both line and neutral conductors can be available when the light monitor 120 is intended to be operational. Accordingly, the light monitor 120 can be a simplified embodiment that eliminates the need for a power storage cell.

The light monitor 120 may be individually identifiable. With certain embodiments, a unique ID 460 of the light monitor 120 may allow the light monitor 120 to be uniquely identified on the system 100. The unique ID 460 may facilitate pairing the light monitor 120 with the system controller 170 and/or the mobile controller(s) 175 in some way. Any one or combination of several methods (e.g., bar code, QR code on the device packaging, serial number, device reader connected to computer, etc.) could be employed to provide the unique ID 460.

In some embodiments, a default mode for the light monitor 120 may include the switch 465 being enabled so that, when the light source 115 is first turned on with the light monitor 120 installed, the power charging source 405 may be able to charge the power storage 410. The power storage 410 could be pre-charged in some embodiments to allow the light monitor 120 to operate when first installed. With start-up of the light monitor 120, the light monitor 120 may be registered and paired with the system controller 170, if such has not already been done.

Certain embodiments of the light monitor 120 may generate an automatic threshold by learning the normal operating state of the light monitor 120. In such embodiments, the light monitor 120 may monitor the normal operating flow of current from when the light source 115 is switched on to when it reaches steady state. Typically, there is a surge of current when devices are switched on which then settles down to a lower value at steady state. Some devices may have varying current profiles. In these cases, the profiles or at least certain peaks may be recorded.

By monitoring the normal current flow over time, certain embodiments may be configured to provide a warning when the operating conditions are steadily changing over a period of time. For example, the light monitor 120 may provide indication to the system controller 170 and/or the mobile controller(s) 175 that there is an impending component failure, and the system controller 170 and/or the mobile controller 175 may present a warning. An impending component failure state, for example, could be detected if the light source 115 starts to take more current over time when the light source 115 is powered. The light monitor 120 may be configured for other states, as well.

In some embodiments, the electric light assembly 105 may be configured to provide additional features of control that would provide an advantageous means to automate light sources 115 within a home, office, and/or any appropriate environment. For example, certain embodiments of the electric light assembly 105 may be configured to control the power flow to the light source 115 by conducting or not conducting current so as to turn the light source 115 on and off. In some embodiments, the electric light assembly 105 may also be able to regulate the current and voltage so as to provide a gradient of control beyond binary control of simply powering or not powering the light source 115.

Figure 5:
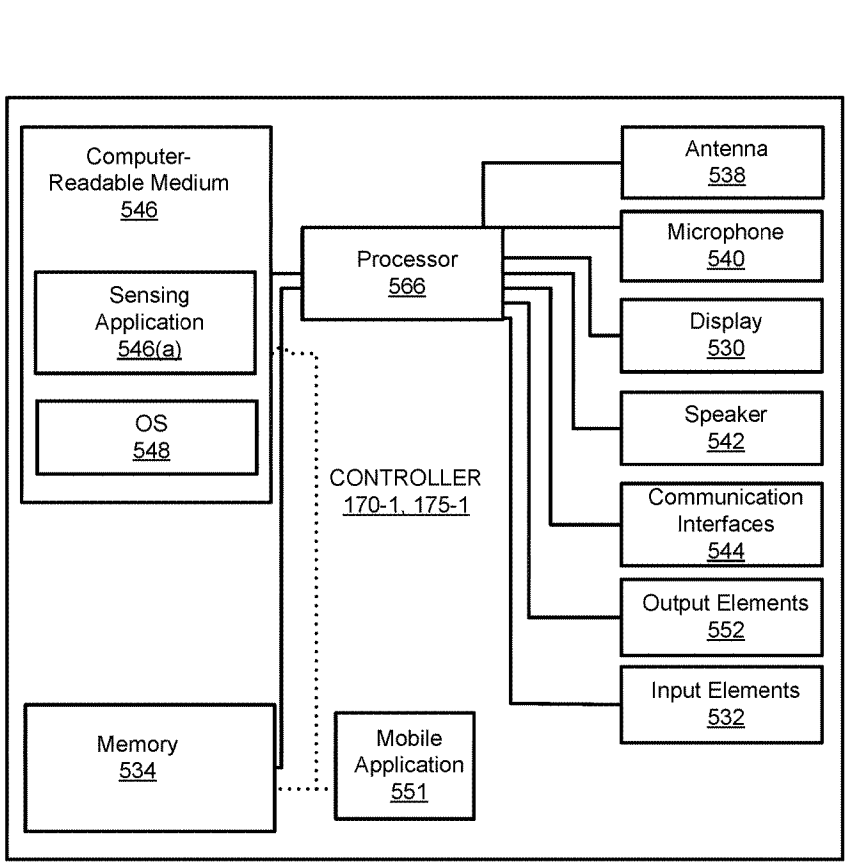
FIG. 5 is a functional block diagram of a computing device, which may correspond to one or more controllers, according to certain embodiments of the present disclosure.

FIG. 5 is a functional block diagram of a computing device 500, which may correspond to one or more of controllers 170-1 and/or 175-1, according to certain embodiments of the present disclosure. In some embodiments, the computing device 500 may be mobile computing device. In some embodiments, the computing device 500 may be provided with a mobile application 551 configured to run on the computing device 500 to facilitate various embodiments of this disclosure. In some embodiments, instead of a mobile application 551, another type of application or instruction set may be configured to run on the computing device 500 to facilitate various embodiments of this disclosure. The computing device 500 may be any portable device suitable for sending and receiving information in accordance with embodiments described herein. For example without limitation, in various embodiments, the computing device 500 may include one or more of a mountable control unit, a mobile phone, a cellular telephone, a smartphone, a handheld mobile device, a tablet computer, a web pad, a personal digital assistant (PDA), a notebook computer, a handheld computer, a laptop computer, or the like.

As shown in FIG. 5, the computing device 500 includes a display 530 and input elements 532 to allow a user to input information into the computing device 500. By way of example without limitation, the input elements 532 may include one or more of a keypad, a trackball, a touchscreen, a touchpad, a pointing device, a microphone, a voice recognition device, or any other appropriate mechanism for the user to provide input. The display 530 may include a resistive or capacitive screen. The display 530 may be configured for stylus sensitivity which allows movement of the stylus on the screen to be detected. The touch-screen capability may be achieved via an electronic position location system capable of determining a location of a selected region of the display screen. A commercially available electronic position location system like the ones that are used in many commercially available devices such as personal digital assistants, tablet PCs, and smartphones, may be used. An exemplary system may comprise a glass or plastic plate with a metallic coating facing a metallic coating on an underside of a layer of Mylar™ above the glass or plastic plate.

The input elements 532 may include one or more of: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like. The computing device 500 includes a memory 534 communicatively coupled to a processor 536 (e.g., a microprocessor) for processing the functions of the computing device 500. The computing device 500 may include at least one antenna 538 for wireless data transfer. The computing device 500 may also include a microphone 540 to allow a user to transmit voice communication through the computing device 500, and a speaker 542 to allow the user to hear alarms, voice communication, music, etc. In addition, the computing device 500 may include one or more interfaces in addition to the antenna 538, e.g., a wireless interface coupled to an antenna. The communications interfaces 544 can provide a near field communication interface (e.g., contactless interface, Bluetooth, ZigBee, optical interface, etc.) and/or wireless communications interfaces capable of communicating through a cellular network, such as GSM, or through Wi-Fi, such as with a wireless local area network (WLAN). Accordingly, the computing device 500 may be capable of transmitting and receiving information wirelessly through both short range, radio frequency (RF) and cellular and Wi-Fi connections.

The computing device 500 can also include at least one computer-readable medium 546 coupled to the processor 536, which stores application programs and other computer code instructions for operating the device, such as an operating system (OS) 548. The mobile application 551 may be stored in the memory 534 and/or computer-readable media 546. In certain embodiments, the computing device 500 may include a non-transitory computer-readable storage medium, e.g., memory 534. The computer-readable medium 546 can include a sensing application 546(*a*) to gather and/or process any suitable information regarding sensors (e.g., temperature, light, etc.) in accordance with various embodiments, including, for example, data gathered from sensors of the computing device 500.

Figure 6:
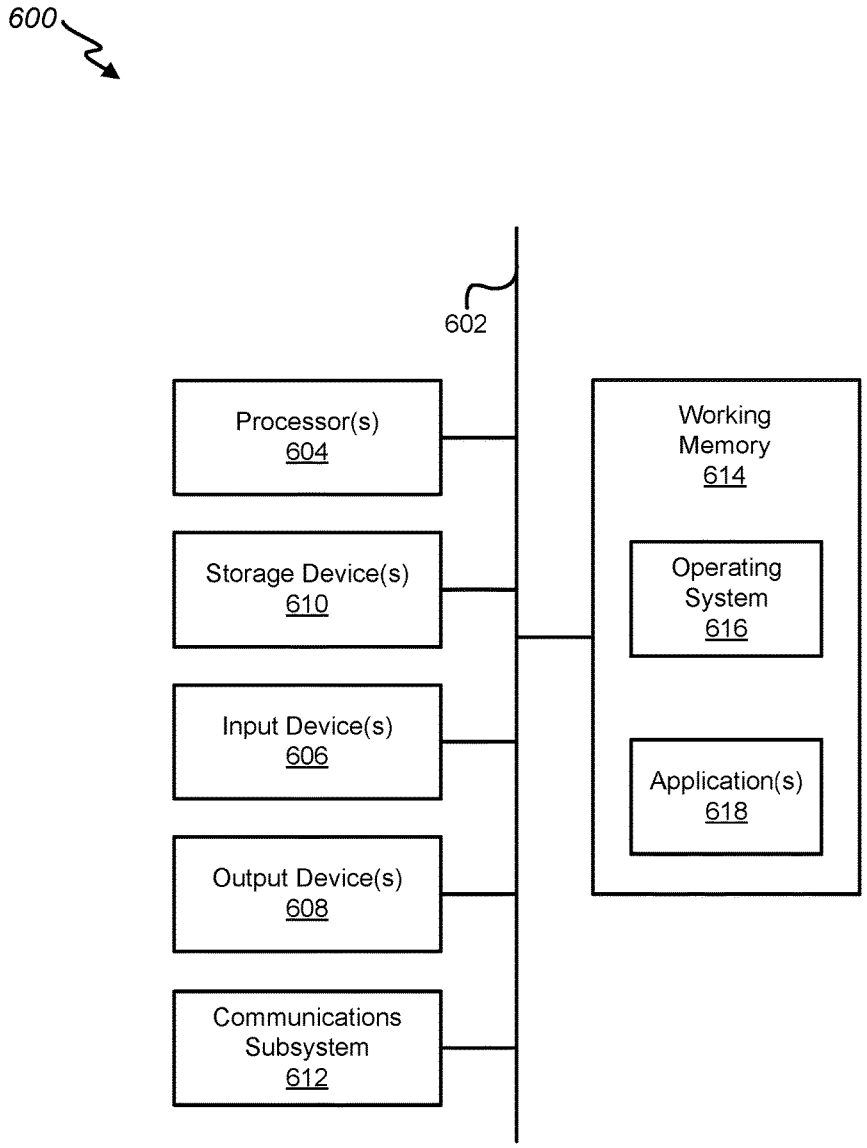
FIG. 6 illustrates a computer system, in accordance with certain embodiments of the present disclosure.

A computer system as illustrated in FIG. 6 may be incorporated as part of the previously described computerized devices. FIG. 6 provides a schematic illustration of one embodiment of a computer system 600 that can perform various steps of the methods provided by various embodiments. It should be noted that FIG. 6 is meant only to provide a generalized illustration of various components, any or all of which may be utilized as appropriate. FIG. 6, therefore, broadly illustrates how individual system elements may be implemented in a relatively separated or relatively more integrated manner.

The computer system 600 is shown comprising hardware elements that can be electrically coupled via a bus 605 (or may otherwise be in communication, as appropriate). The hardware elements may include one or more processors 610, including without limitation one or more general-purpose processors and/or one or more special-purpose processors (such as digital signal processing chips, graphics acceleration processors, video decoders, and/or the like); one or more input devices 615, which can include without limitation a mouse, a keyboard, remote control, and/or the like; and one or more output devices 620, which can include without limitation a display device, a printer, and/or the like.

The computer system 600 may further include (and/or be in communication with) one or more non-transitory storage devices 625, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable and/or the like. Such storage devices may be configured to implement any appropriate data stores, including without limitation, various file systems, database structures, and/or the like.

The computer system 600 might also include a communications subsystem 630, which can include without limitation a modem, a network card (wireless or wired), an infrared communication device, a wireless communication device, and/or a chipset (such as a Bluetooth™ device, an 802.11 device, a WiFi device, a WiMax device, cellular communication device, etc.), and/or the like. The communications subsystem 630 may permit data to be exchanged with a network (such as the network described below, to name one example), other computer systems, and/or any other devices described herein. In many embodiments, the computer system 600 will further comprise a working memory 635, which can include a RAM or ROM device, as described above.

The computer system 600 also can comprise software elements, shown as being currently located within the working memory 635, including an operating system 640, device drivers, executable libraries, and/or other code, such as one or more application programs 645, which may comprise computer programs provided by various embodiments, and/or may be designed to implement methods, and/or configure systems, provided by other embodiments, as described herein. Merely by way of example, one or more procedures described with respect to the method(s) discussed above might be implemented as code and/or instructions executable by a computer (and/or a processor within a computer); in an aspect, then, such code and/or instructions can be used to configure and/or adapt a general purpose computer (or other device) to perform one or more operations in accordance with the described methods.

A set of these instructions and/or code might be stored on a non-transitory computer-readable storage medium, such as the non-transitory storage device(s) 625 described above. In some cases, the storage medium might be incorporated within a computer system, such as computer system 600. In other embodiments, the storage medium might be separate from a computer system (e.g., a removable medium, such as a compact disc), and/or provided in an installation package, such that the storage medium can be used to program, configure, and/or adapt a general purpose computer with the instructions/code stored thereon. These instructions might take the form of executable code, which is executable by the computer system 600 and/or might take the form of source and/or installable code, which, upon compilation and/or installation on the computer system 600 (e.g., using any of a variety of generally available compilers, installation programs, compression/decompression utilities, etc.), then takes the form of executable code.

It will be apparent to those skilled in the art that substantial variations may be made in accordance with specific requirements. For example, customized hardware might also be used, and/or particular elements might be implemented in hardware, software (including portable software, such as applets, etc.), or both. Further, connection to other computing devices such as network input/output devices may be employed.

As mentioned above, in one aspect, some embodiments may employ a computer system (such as the computer system 600) to perform methods in accordance with various embodiments of the invention. According to a set of embodiments, some or all of the procedures of such methods are performed by the computer system 600 in response to processor 610 executing one or more sequences of one or more instructions (which might be incorporated into the operating system 640 and/or other code, such as an application program 645) contained in the working memory 635. Such instructions may be read into the working memory 835 from another computer-readable medium, such as one or more of the non-transitory storage device(s) 825. Merely by way of example, execution of the sequences of instructions contained in the working memory 635 might cause the processor(s) 610 to perform one or more procedures of the methods described herein.

The terms "machine-readable medium," "computer-readable storage medium" and "computer-readable medium," as used herein, refer to any medium that participates in providing data that causes a machine to operate in a specific fashion. These mediums may be non-transitory. In an embodiment implemented using the computer system 600, various computer-readable media might be involved in providing instructions/code to processor(s) 610 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the non-transitory storage device(s) 625. Volatile media include, without limitation, dynamic memory, such as the working memory 635.

Common forms of physical and/or tangible computer-readable media include, for example, a floppy disk, a flexible disk, hard disk, magnetic tape, or any other magnetic medium, a CD-ROM, any other optical medium, any other physical medium with patterns of marks, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 610 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 600.

The communications subsystem 630 (and/or components thereof) generally will receive signals, and the bus 605 then might carry the signals (and/or the data, instructions, etc. carried by the signals) to the working memory 635, from which the processor(s) 610 retrieves and executes the instructions. The instructions received by the working memory 635 may optionally be stored on a non-transitory storage device 625 either before or after execution by the processor(s) 610.

It should further be understood that the components of computer system 600 can be distributed across a network. For example, some processing may be performed in one location using a first processor while other processing may be performed by another processor remote from the first processor. Other components of computer system 600 may be similarly distributed. As such, computer system 600 may be interpreted as a distributed computing system that performs processing in multiple locations. In some instances, computer system 600 may be interpreted as a single computing device, such as a distinct laptop, desktop computer, or the like, depending on the context.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

While the principles of the disclosure have been described above in connection with specific apparatuses and methods, it is to be clearly understood that this description is made only by way of example and not as limitation on the scope of the disclosure. Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

Also, the terms in the claims have their plain, conventional meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

What is claimed:

1. A system to facilitate electric lighting device management, the system comprising:

a light monitor adapted to be disposed in an electric light assembly, the electric light assembly comprising an electric light source and a receptacle adapted to receive the electric light source, and the light monitor configured to:

monitor one or more conditions of at least a portion of the electric light assembly;

based at least in part on the monitoring, store a plurality of data recordings corresponding to operations of the electric light assembly over a period of time;

create reporting data based at least in part on the stored plurality of data recordings; and wirelessly transmit a communication toward a system controller that is remote from the electric light assembly, the communication comprising the reporting data;

wherein the light monitor corresponds to the electric light source or a receptacle adapted to receive the electric light source.

2. The system to facilitate electric lighting device management of claim 1, wherein the wirelessly transmitting the communication toward the system controller comprises:

transmitting the communication directly to the system controller.

3. The system to facilitate electric lighting device management of claim 1, wherein the wirelessly transmitting the communication toward the system controller comprises:

transmitting the communication indirectly to the system controller by way of one or more other electric light assemblies.

4. The system to facilitate electric lighting device management of claim 1, wherein the light monitor is further configured to control one or more functions of the electric light source.

5. The system to facilitate electric lighting device management of claim 1, wherein the light monitor is further configured to generate an assessment of the one or more functions of the electric light source, and wherein the reporting data comprises the assessment, the assessment indicating a remaining operational expectancy of the electric light source.

6. The system to facilitate electric lighting device management of claim 1, further comprising:

the system controller, wherein the system controller is configured to:

wirelessly communicate with a set of light monitors, the set of light monitors comprising said light monitor; and monitor the set of light monitors.

7. The system to facilitate electric lighting device management of claim 6, wherein the system controller is further configured to generate an assessment of one or more functions of the electric light source based at least in part on the reporting data, and wherein the assessment indicates a remaining operational expectancy of the electric light source.

8. A method to facilitate electric lighting device management, the method comprising:

monitoring, with a light monitor adapted to be disposed in an electric light assembly, one or more conditions of at least a portion of the electric light assembly, the electric light assembly comprising an electric light source and a receptacle adapted to receive the electric light source;

based at least in part on the monitoring, storing, with the light monitor, a plurality of data recordings corresponding to operations of the electric light assembly over a period of time;

creating, with the light monitor, reporting data based at least in part on the stored plurality of data recordings; and wirelessly transmitting, with the light monitor, a communication toward a system controller that is remote from the electric light assembly, the communication comprising the reporting data;

wherein the light monitor corresponds to the electric light source or a receptacle adapted to receive the electric light source.

9. The method to facilitate electric lighting device management of claim 8, wherein the wirelessly transmitting the communication toward the system controller comprises:

transmitting the communication directly to the system controller.

10. The method to facilitate electric lighting device management of claim 8, wherein the wirelessly transmitting the communication toward the system controller comprises:

transmitting the communication indirectly to the system controller by way of one or more other electric light assemblies.

11. The method to facilitate electric lighting device management of claim 8, further comprising:

controlling one or more functions of the electric light source.

12. The method to facilitate electric lighting device management of claim 8, further comprising:

generating an assessment of one or more functions of the electric light source, wherein the reporting data comprises the assessment, the assessment indicating a remaining operational expectancy of the electric light source.

13. The method to facilitate electric lighting device management of claim 8, further comprising:

wirelessly communicating, with the system controller, with a set of light monitors, the set of light monitors comprising said light monitor; and monitoring, with the system controller, the set of light monitors.

14. The method to facilitate electric lighting device management of claim 13, wherein the system controller is further configured to generate an assessment of one or more functions of the electric light source based at least in part on the reporting data, and wherein the assessment indicates a remaining operational expectancy of the electric light source.

15. A non-transitory, machine-readable medium having machine-readable instructions thereon which, when executed by a processing device, facilitates electric lighting device management, causing the processing device to:

monitor one or more conditions of at least a portion of an electric light assembly, the electric light assembly comprising an electric light source and a receptacle adapted to receive the electric light source;

based at least in part on the monitoring, store a plurality of data recordings corresponding to operations of the electric light assembly over a period of time;

create reporting data based at least in part on the stored plurality of data recordings; and wirelessly transmit a communication toward a system controller that is remote from the electric light assembly, the communication comprising the reporting data;

wherein the processing device corresponds to the electric light source or a receptacle adapted to receive the electric light source.

16. The non-transitory, machine-readable medium of claim 15, wherein the wirelessly transmitting the communication toward the system controller comprises:

transmitting the communication directly to the system controller.

17. The non-transitory, machine-readable medium of claim 15, wherein the wirelessly transmitting the communication toward the system controller comprises:

transmitting the communication indirectly to the system controller by way of one or more other electric light assemblies.

18. The non-transitory, machine-readable medium of claim 15, the machine-readable instructions further causing the processing device to:

control one or more functions of the electric light source.

19. The non-transitory, machine-readable medium of claim 15, the machine-readable instructions further causing the processing device to:

generate an assessment of one or more functions of the electric light source, and wherein the reporting data comprises the assessment, the assessment indicating a remaining operational expectancy of the electric light source.

20. The non-transitory, machine-readable medium of claim 15, the machine-readable instructions further causing the processing device to:

wirelessly communicate, with the system controller, with a set of monitors, the set of monitors comprising a light monitor that includes the machine-readable medium.

* * * * *